US007035794B2

(12) United States Patent
Sirivara

(10) Patent No.: US 7,035,794 B2
(45) Date of Patent: Apr. 25, 2006

(54) COMPRESSING AND USING A CONCATENATIVE SPEECH DATABASE IN TEXT-TO-SPEECH SYSTEMS

(75) Inventor: Sudheer Sirivara, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 624 days.

(21) Appl. No.: 09/822,547

(22) Filed: Mar. 30, 2001

(65) Prior Publication Data

US 2002/0143543 A1 Oct. 3, 2002

(51) Int. Cl.
*G10L 19/04* (2006.01)

(52) U.S. Cl. ..... 704/219; 704/258; 704/260; 704/262

(58) Field of Classification Search ..... 704/260, 704/267, 258, 219, 262
See application file for complete search history.

(56) References Cited

U.S. PATENT DOCUMENTS 5,153,913 A * 10/1992 Kandefer et al. ..... 704/260
5,717,827 A * 2/1998 Narayan ..... 704/260
5,774,855 A * 6/1998 Foti et al. ..... 704/267
6,453,383 B1 * 9/2002 Stoddard et al. ..... 711/112
6,553,375 B1 * 4/2003 Huang et al. ..... 707/10
6,625,576 B1 * 9/2003 Kochanski et al. ..... 704/260
6,665,641 B1 * 12/2003 Coorman et al. ..... 704/260
2001/0014860 A1 * 8/2001 Kivimaki ..... 704/260
2002/0103646 A1 * 8/2002 Kochanski et al. ..... 704/260
2003/0028380 A1 * 2/2003 Freeland et al. ..... 704/260

* cited by examiner

*Primary Examiner*—W. R. Young
*Assistant Examiner*—Huyen X. Vo
(74) *Attorney, Agent, or Firm*—Blakely, Sokoloff, Taylor & Zafman LLP

(57) ABSTRACT

A method and apparatus are provided for compressing and using a concatenative speech database in TTS systems to improve the quality of speech output generated by handheld TTS systems by allowing synthesis to occur on the client. According to one embodiment of the present invention, a G.723 encoder receives diphone waveforms, and compresses them into diphone residuals. While compressing the diphone waveforms, the encoder generates Linear Predictive Coding (LPC) coefficients. The diphone residuals, and the encoder-generated LPC coefficients are then stored in encoder-generated compressed packet.

14 Claims, 7 Drawing Sheets

COMPRESSING AND USING A CONCATENATIVE SPEECH DATABASE IN TEXT-TO-SPEECH SYSTEMS

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

This invention generally relates to the field of speech synthesis and speech Input/Output (I/O) applications. More specifically, the invention relates to compressing and using a concatenative speech database in text-to-speech (TTS) systems.

BACKGROUND OF THE INVENTION

Converting text into voice output using speech synthesis techniques is nothing new. A variety of TTS systems are available today, and are getting increasingly natural and intelligent. However, the conventional TTS systems based on formant synthesis and articulatory synthesis are not mature enough to produce the same quality of synthetic speech, as one would obtain from a concatenative database approach.

For instance, rule-based synthesizers, in the form or formant synthesizers, relate to formant and anti-formant frequencies and bandwidth. Such rule-based synthesizers produce errors, because formant frequencies and bandwidths are difficult to estimate from speech data. Rule-based synthesizers are useful for handling the articulatory aspects of changes in speaking style. In a rule-based system, the acoustic parameter values for the utterance are generated entirely by algorithmic means. A set of rules sensitive to the linguistic structure generates a collection of values, such as frequencies and bandwidths that capture the perceptually important cues for reproducing the spoken utterance. A set of procedures modifies these cues in accordance with the values specified for a number of parameters to produce the desired voice quality. A synthesizer generates the final speech waveform from the parameter values. Rule-based approaches require extensive knowledge and understanding of the sound patterns of speech. Rule-based synthesizers are a long way from being naturalistic, in comparison to the concatenative synthesizers, and therefore, the results based on a rule-based synthesizer are less realistic.

To achieve better quality of speech, TTS systems using concatenative speech database are currently very popular and widely used. Although a TTS system based on a concatenative database provides better quality of speech in comparison to the conventional systems mentioned above, minimizing the database size, without compromising the speech quality, is a major obstacle the system faces today. For instance, a TTS system based on a concatenative database approach employs, among other things, a diphone database, to completely map the range of human speech production, which results in a very large effective size (perhaps, up to 6 MB) of the concatenative database. Thus, implementing a TTS system using concatenative database in devices with limited memory, such as handheld devices, or which rely upon Internet download of customizable speech databases (e.g. for character voices) is particularly difficult due to the large size of the speech database. Most conventional compressions of speech database in TTS systems are limited to mu-law and A-law compressions, which are essentially forms of non-linear quantization. These methods produce only a minimal compression.

BRIEF DESCRIPTION OF THE DRAWINGS

The appended claims set forth the features of the invention with particularity. The invention, together with its advantages, may be best understood from the following detailed description taken in conjunction with the accompanying drawings of which:

DETAILED DESCRIPTION

A method and apparatus are described for compressing a concatenative speech database in a TTS system. Broadly stated, embodiments of the present invention allow the size of a concatenative diphone database to be reduced with minimal difference in quality of resulting synthesized speech compared to that produced from an uncompressed database.

According to one embodiment, the effective compression ratio achieved is approximately 20:1 for the diphone waveform portion of the database. Advantageously, due to the small memory footprint of the compressed concatenative diphone database, TTS systems may be deployed in handheld devices or other environments with limited memory and low MIPS. Further, it facilitates easy download of customizable speech database (character voices) to be used with the waveform synthesizer along with any desired audio effects. The quality of synthesized speech in web-enabled handheld devices will also be much better, as synthesis is performed on client-side, and it eliminates the network artifacts on streaming audio when rendered from a website.

In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form.

The present invention includes various steps, which will be described below. The steps of the present invention may be performed by hardware components or may be embodied in machine-executable instructions, which may be used to cause a general-purpose or special-purpose processor or logic circuits programmed with the instructions to perform the steps. Alternatively, the steps may be performed by a combination of hardware and software.

The present invention may be provided as a computer program product, which may include a machine-readable medium having stored thereon instructions, which may be used to program a computer (or other electronic devices) to perform a process according to the present invention. The machine-readable medium may include, but is not limited to, floppy diskettes, optical disks, CD-ROMs, and magneto-optical disks, ROMs, RAMs, EPROMs, EEPROMs, magnetic or optical cards, flash memory, or other type of media/machine-readable medium suitable for storing electronic instructions. Moreover, the present invention may also be downloaded as a computer program product, wherein the program may be transferred from a remote computer to a requesting computer by way of data signals embodied in a carrier wave or other propagation medium via a communication link (e.g., a modem or network connection).

Figure 1:
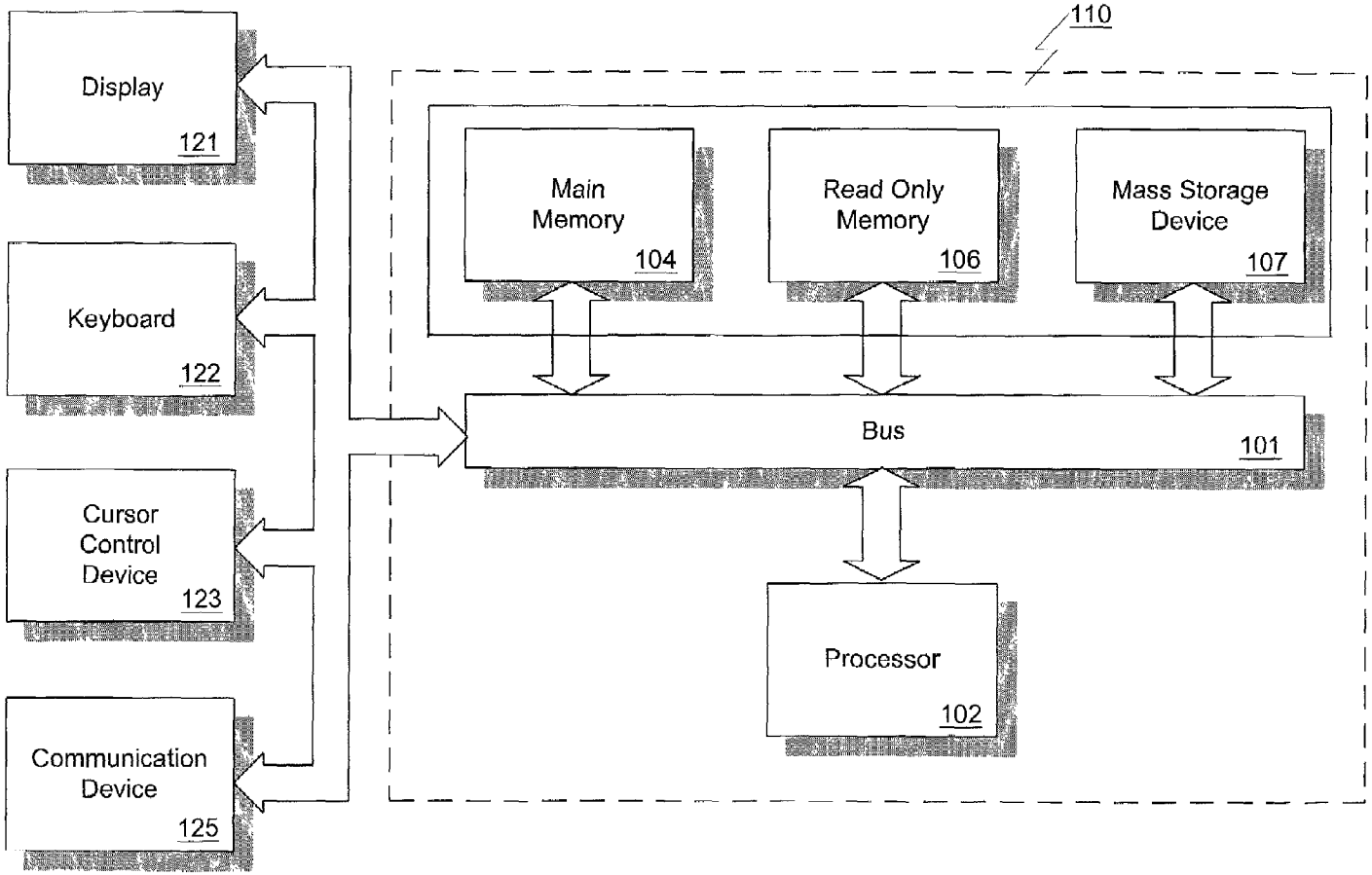
FIG. 1 is a block diagram of a typical computer system upon which one embodiment of the present invention may be implemented.

FIG. 1 is a block diagram of a typical computer system upon which one embodiment of the present invention may be implemented. Computer system 100 comprises a bus or other communication means 101 for communicating information, and a processing means such as processor 102 coupled with bus 101 for processing information. Computer system 100 further comprises a random access memory (RAM) or other dynamic storage device 104 (referred to as main memory), coupled to bus 101 for storing information and instructions to be executed by processor 102. Main memory 104 also may be used for storing temporary variables or other intermediate information during execution of instructions by processor 102. Computer system 100 also comprises a read only memory (ROM) and/or other static storage device 106 coupled to bus 101 for storing static information and instructions for processor 102.

A data storage device 107 such as a magnetic disk or optical disc and its corresponding drive may also be coupled to computer system 100 for storing information and instructions. Computer system 100 can also be coupled via bus 101 to a display device 121, such as a cathode ray tube (CRT) or Liquid Crystal Display (LCD), for displaying information to an end user. Typically, an alphanumeric input device 122, including alphanumeric and other keys, may be coupled to bus 101 for communicating information and/or command selections to processor 102. Another type of user input device is cursor control 123, such as a mouse, a trackball, or cursor direction keys for communicating direction information and command selections to processor 102 and for controlling cursor movement on display 121.

A communication device 125 is also coupled to bus 101. The communication device 125 may include a modem, a network interface card, or other well-known interface devices, such as those used for coupling to Ethernet, token ring, or other types of physical attachment for purposes of providing a communication link to support a local or wide area network, for example. In this manner, the computer system 100 may be coupled to a number of clients and/or servers via a conventional network infrastructure, such as a company's Intranet and/or the Internet, for example.

It is appreciated that a lesser or more equipped computer system than the example described above may be desirable for certain implementations. For example, web-enabled handheld devices, such as a pocket PC, or the Palm. Therefore, the configuration of computer system 100 will vary from implementation to implementation depending upon numerous factors, such as price constraints, performance requirements, technological improvements, and/or other circumstances.

It should be noted that, while the steps described herein may be performed under the control of a programmed processor, such as processor 102, in alternative embodiments, the steps may be fully or partially implemented by any programmable or hard-coded logic, such as Field Programmable Gate Arrays (FPGAs), TTL logic, or Application Specific Integrated Circuits (ASICs), for example. Additionally, the method of the present invention may be performed by any combination of programmed general-purpose computer components and/or custom hardware components. Therefore, nothing disclosed herein should be construed as limiting the present invention to a particular embodiment wherein the recited steps are performed by a specific combination of hardware components.

Figure 2:
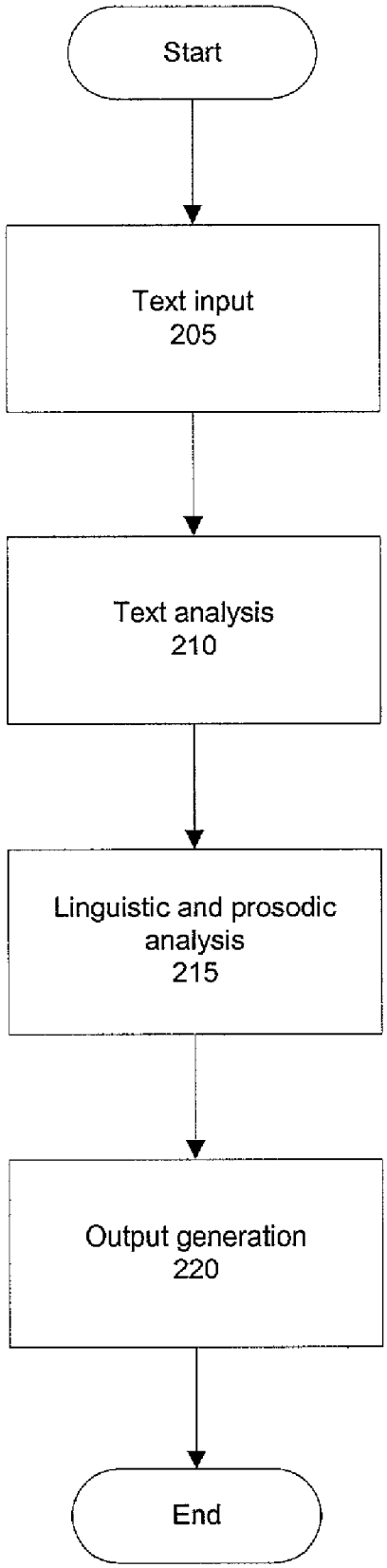
FIG. 2 is a flow diagram illustrating a text-to-speech system process, according to one embodiment of the present invention.

FIG. 2 is a flow diagram illustrating an overview of a text-to-speech system process, according to one embodiment of the present invention. First, the original text is input into the TTS system in processing block 205. In the text analysis module, the text is analyzed by dividing it into sentences, and further into words, abbreviations, and other alphanumeric strings in processing block 210. In the linguistic and prosodic analysis module, phonemes, the smallest linguistic units, are analyzed according to their assigned languages in processing block 215. The analysis in the linguistic and prosodic analysis module begins by employing the parts-of-speech designations as inputs into the accent generator, which identifies points within the sentence that require changes in the intonation or pitch contour. At processing block 220, the waveform synthesizer receives the acoustic sequence specifications from the linguistic and prosodic analysis module, and generates a human-sounding digital audio output.

Figure 3:
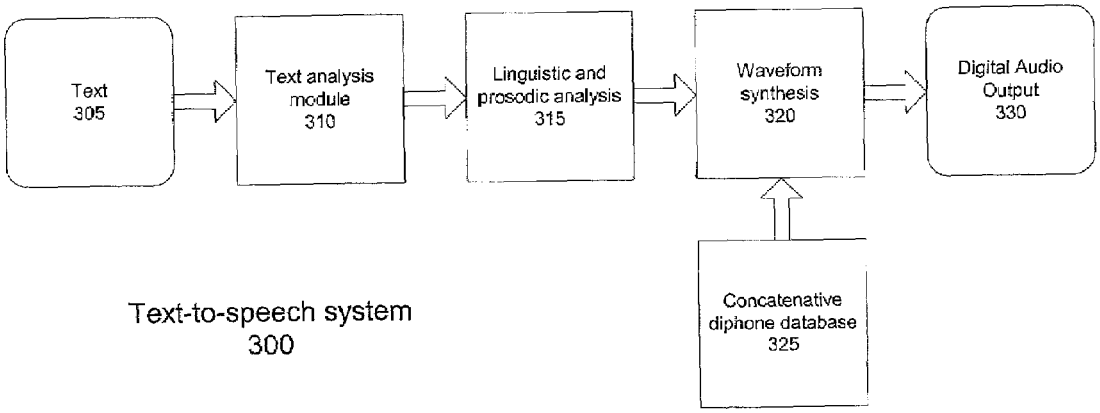
FIG. 3 is a block diagram illustrating a text-to-speech system based on a concatenative database system, according to one embodiment of the present invention.

FIG. 3 is a block diagram illustrating a text-to-speech system 300 based on a concatenative database system, according to one embodiment of the present invention. As illustrated, the TTS system 300 comprises text 305, a text analysis module 310, and a linguistic and prosodic analysis module 315, followed by a speech waveform synthesizer 320, which accesses and uses the concatenative speech diphone database 325, and generates digital audio output 330. First, the text 305 is input into the TTS system 300. The text 305 is then analyzed by the text analysis module 310, in order to properly process the text 305, into some form of linguistic representation such as sentences, phrases, words, and further, into phonemes. A phoneme is the smallest linguistic unit in a TTS system. In addition to reducing the text 305 into phonemes, it is further sorted by prefixes, roots, and suffixes, and identified as abbreviations, acronyms, and numbers.

First, in the text analysis module 310, chunks of input text are designated, mainly for the purposes of limiting the amount of input text that must be processed in a single pass of the algorithmic core. Chunks typically correspond to individual sentences. The sentences are further divided, or "tokenized" into regular words, abbreviations, and other special alphanumeric strings using spaces and punctuation as cues. Each word may then be categorized into its parts-of-speech designation.

The analyzed text is then decomposed into sounds, more generally described as acoustic units. Most of the acoustic units for languages like English are obtained from a pronunciation dictionary. Other acoustic units corresponding to words, not in the dictionary, are generated by letter-to-sound rules for each language. The symbols representing acoustic units produced by the dictionary and letter-to-sound rules may typically correspond to phonemes or syllables in a particular language. Although many systems currently described in the literature may specify units containing strings of multiple phonemes or syllables.

The linguistic and prosodic analysis module 315 may begin by employing the parts-of-speech designations as inputs into the accent generator, which identifies points within a sentence that require changes in the intonation or pitch contour (up, down, flattening). The pitch contour may be further refined by segmenting current sentences into intonational phrases. Intonational phrases are sections of speech characterized by a distinctive pitch contour, which usually declines at the end of each phrase. Phrase boundaries are demarcated principally by punctuation. Other heuristics may be employed to define phrases in the absence of punctuation.

The next step in generating prosodic information is the determination of the durations of each of the acoustic units in the sequence. Rule-based and statistically-derived data are typically utilized in determining individual unit duration including the unit identity, as well as the stress applied to the syllable containing the unit, and the location of the unit in the phrase. When acoustic unit durations are determined, additional refinement of intonation may take place using the duration values. These additional target pitch values would then be time-located within the acoustic sequence. This step may be followed by a generation of final, time-continuous pitch contours by interpolating and then smoothing the sparse target pitch values.

Further, as part of the linguistic analysis, in the linguistic and prosodic analysis module 315, the phonemes are analyzed according to their assigned language system. For example, if the text 305 is in Greek, the phonemes are evaluated according to the Greek language rules (such as Greek pronunciation). As a result of the prosodic analysis 315, each phoneme is assigned an individual identity containing various features, such as location in the phrase, accent, and syllable stress.

The next module is the waveform synthesizer 320. Generally, a waveform synthesizer might implement one of many types of speech synthesis like the articulatory, formant, diphone-based, or canned speech synthesis. The illustrated waveform synthesizer 320 is a diphone-based synthesizer. The waveform synthesizer 320 accepts diphone residuals, linear predictive coding (LPC) coefficients (when they are compressed using the LPC); pitch mark values (pitch marks), and finally, constructs a synthesized speech.

According to one embodiment of the present invention, the speech waveform synthesizer 320 receives the acoustic sequence specification of the original sentence from the linguistic and prosodic analysis module 315, and the concatenative diphone database 325, to generate a human-sounding digital audio output 330. The speech waveform generation section 320 may generate an audible signal by employing a model of the vocal tract to produce a base waveform that is modulated according to the acoustic sequence specification to produce a digital audio waveform file. Another method of generating an audible signal is through the concatenation of small portions of digital audio, pre-recorded with a human voice. A series of concatenated units is then modulated according to the parameters of the acoustic sequence specification to produce a digital audio waveform file. In most cases, the concatenated digital audio units will have a one-on-one correspondence to the acoustic units in the acoustic sequence specification. The resulting digital audio waveform file may be rendered into audio by converting it into an analog signal, and then transmitting the analog signal to a speaker.

Finally, the waveform synthesizer 320 accesses and uses the concatenative diphone database 325 to produce the intended speech output 330. A diaphone is the smallest unit of speech for efficient TTS conversion that is derived from Phonemes. A diaphone spans over two phonemes so that the concatenation occurs at stable points, which a phoneme does not afford. The waveform synthesizer 320 produces the intended speech output by putting together the concatenative speech segments extracted from natural speech. As described above, concatenative systems can produce very natural sounding output 330. In a concatenative system, to achieve high quality of speech output 330, a large set of diaphones 325 is typically created for generating every possible speech and voice style. Therefore, even when only a limited number of sounds are produced, the memory requirement, when using a concatenative system, is high. The memory demands are difficult to meet when using a device with a smaller memory, such as a handheld device.

Figure 4:
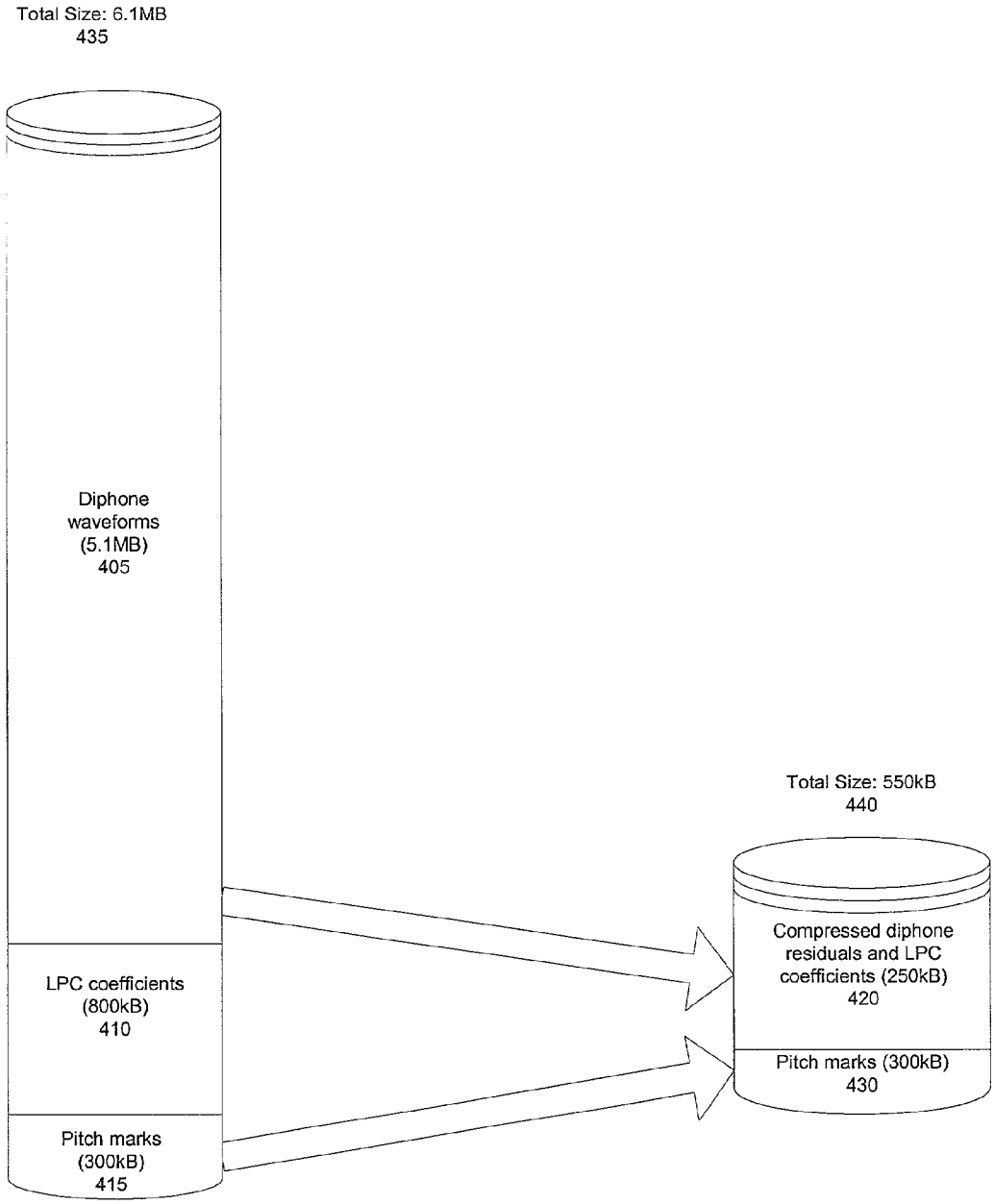
FIG. 4 is a block diagram illustrating a compressed concatenative database format, according to one embodiment of the present invention.

FIG. 4 is a block diagram illustrating a concatenative database format, according to one embodiment of the present invention. As illustrated, the concatenative database 435 comprises speech diphone waveforms 405, LPC coefficients 410, and pitch marks 415. Given that a comprehensive set of diphones is required to completely map the range of human speech production, the effective size of the concatenative database can become very large, on the order of roughly 6 MB. Thus, using a database of such great size in a conventional speech synthesis system is not only inefficient, but also impractical to use, especially in a device with a relatively small memory. However, according to one embodiment of the present invention, the database is compressed to the projected optimal size of only 550 kB 440 comprising compressed diaphone residuals and LPC coefficients 420, and pitch marks 430. As illustrated, the size of the pitch marks 415 and 430 remains constant (at 300 kB). Pitch marks are positions in an utterance where the pitch of the speech changes, where the pitch corresponds to changes in fundamental frequency or F0 changes.

According to one embodiment, the present invention employs a G.723 coder (not shown in FIG. 4) for compressing and decompressing the data. The G.723 coder comprises a G.723 encoder, and a modified G.723 decoder. The G.723 encoder accepts the audio diphone waveforms, and generates compressed diphone residuals and LPC coefficients as a result. The optimal size of the compressed database is achieved using only one set of LPC coefficients—the LPC coefficients generated by the G.723 coder.

A standard G.723 coder is a speech compression algorithm with a dual coding rate of 5.3 and 6.3 kilobits per second. According to quality measured by Mean Option Score (MOS), the G.723 coder quality is 3.98, which is only 0.02 shy of regular telephone quality of 4.00, also known as the "toll" quality. Thus, the G.723 coder can provide voice quality nearly equal to that experienced over a regular telephone.

Figure 5:
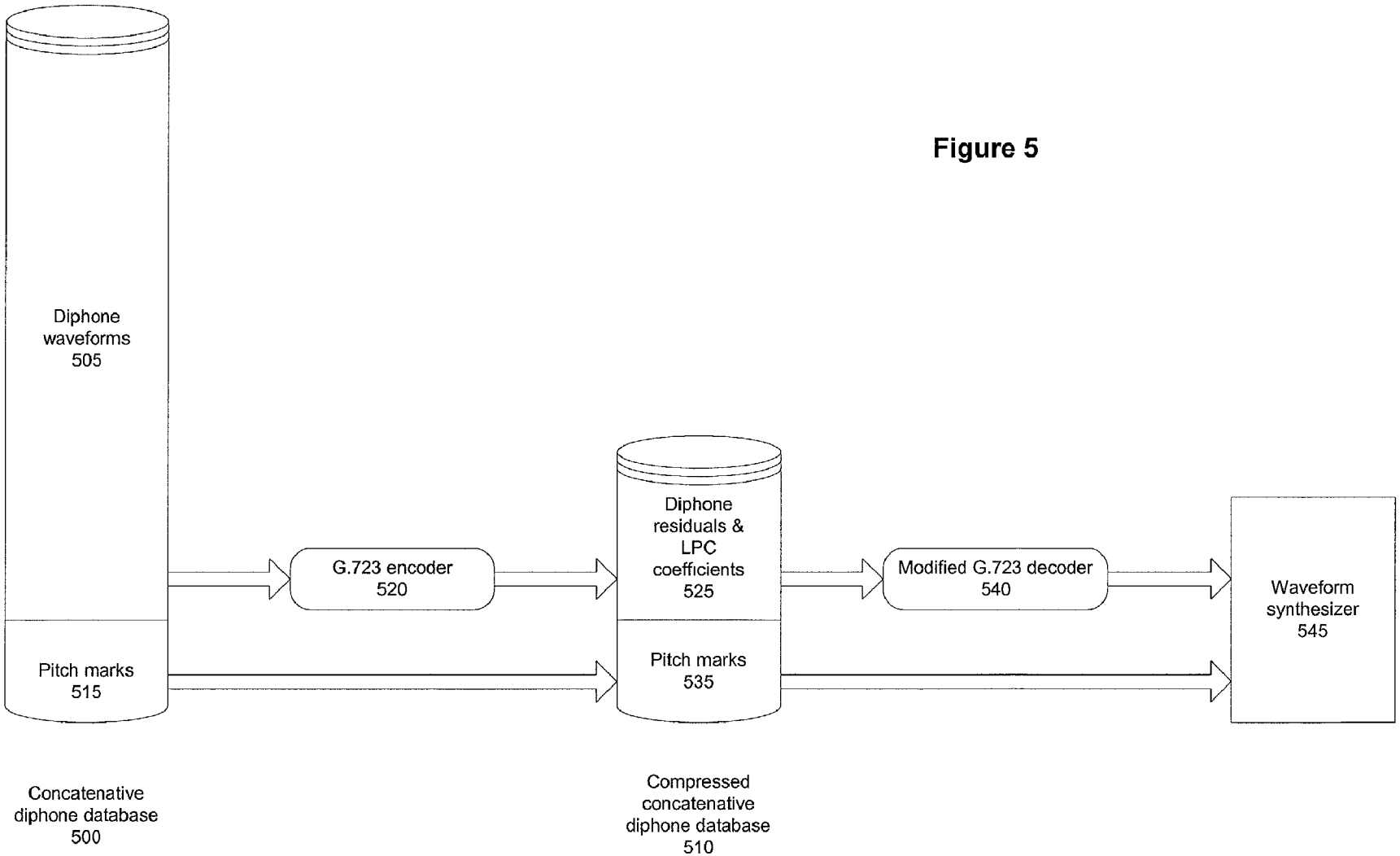
FIG. 5 is a block diagram illustrating concatenative speech database compression in a text-to-speech system, according to one embodiment of the present invention.

FIG. 5 is a block diagram illustrating concatenative speech database compression in a text-to-speech system, according to one embodiment of the present invention. As illustrated in FIG. 3, first, the input text is translated into individual diphone waveforms 505 in a TTS system. As illustrated, the concatenative database 500 comprises diphone waveforms 505, and pitch marks 515. A G.723 coder, comprising a G.723 encoder 520, and a modified G.723 decoder 540, is used for compression and decompression of the data.

According to one embodiment of the present invention, individual audio diphone waveforms 505 are received by the G.723 encoder 520. The diphone waveforms are compressed 525, resulting in compressed diphone residuals and LPC coefficients 525 after passing through the G.723 encoder 520. A G.723 encoder may achieve a compression ratio of up to 20:1, as opposed to the 2:1 ratio achieved using a conventional compression system without a G.723 encoder. As illustrated, the size of the pitch marks 515 and 535 remains constant. Once the data is compressed, it is stored in an encoder-generated compressed packet as part of a compressed concatenative diphone database 510.

According to one embodiment of the present invention, the optimal size of compressed database is achieved by using only one set of LPC coefficients as opposed to using and storing two sets to LPC coefficients. For instance, since the diphone waveforms are input into the G.723 encoder 520, the LPC coefficients are not generated at the input stage. LPC coefficients, along with a set of diphone residuals, are generated when diphone waveforms are passed through the linear predictive coding function. On the other hand, the G.723 encoder 520 generates its own set of LPC coefficients while compressing the input diphone waveforms 505. Thus, according to one embodiment of the present invention, further optimization is achieved by using only the encoder-generated set of LPC coefficients.

If needed, the extraction process of the present invention can be further modified in order to fully utilize the encoder-generated LPC coefficients. Additionally, while storing the LPC coefficients, according to one embodiment, further compression could be achieved by saving just the minimum required set of coefficients for satisfactory synthesis. For instance, only four coefficients would be sufficient for satisfactorily synthesizing 8 kHz speech data.

When the waveform synthesizer 545 requests a particular diphone, the appropriate diphone residual is located, based on the offsets recorded during the compression process. Once located, the diphone is extracted from the encoder-generated compressed packet. This task is accomplished by using the modified G.723 decoder 540. The modified G.723 decoder is from the G.723 static library, which, as mentioned above, also includes a linked-in encoder, called G.723 encoder 520. The compressed data 525 runs through the modified G.723 decoder 540, with a wave header attached to the diphones, and assigned to an appropriate pointer structure in the waveform synthesizer 545. Further, the assigned extra guard bands are not removed, since the waveform synthesizer 545 contains information about the exact sample offsets of where the diphones start and end.

According to one embodiment of the present invention, since the waveform synthesizer 545 requires LPC residuals, the modified decoder 540 may supply the residuals directly to the synthesizer 545 without reconstruction. This ensures that there is no degradation in the quality of the synthesized speech because of the added compression and reconstruction. Further, the pitch marks 515 and 535, which form a small part of the database, are not compressed, and are provided directly to the waveform synthesizer 545.

By employing the compression scheme of the present invention, the size of the concatenative database, comprising diphone waveforms 505 and pitch marks 515, can be reduced from 6.1 MB to about 550 kB, comprising compressed diphone residuals and LPC coefficients 525, and pitch marks 535. The diphone waveforms 505, which comprise the largest part of the database, can be reduced from 5.1 MB to roughly 250 kB of compressed diphone residuals and LPC coefficients 525. Thus, using the compression scheme of the present invention, a compression ratio of 20:1 can be achieved, as opposed to a 2:1 ratio likely to be achieved using a conventional method of compression without a G.723 coder.

Figure 6:
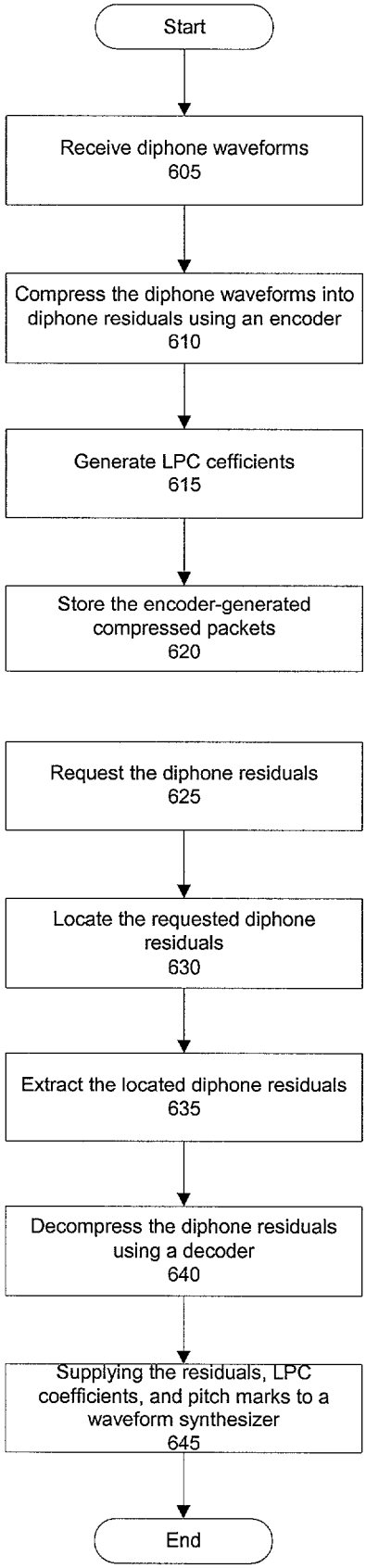
FIG. 6 is a flow diagram illustrating a concatenative speech database compression process in a text-to-speech system, according to one embodiment of the present invention.

FIG. 6 is a flow diagram illustrating a concatenative speech database compression process in a text-to-speech system, according to one embodiment of the present invention. First, diphone waveforms are received in processing block 605. At processing block 610, the diphone waveforms are compressed into diphone residuals using an encoder. According to one embodiment of the present invention, a G.723 coder, comprising a G.723 encoder and a modified G.723 decoder, is used for compression and decompression of data. While compressing the diphone residuals, the encoder generates a set of LPC coefficients in processing block 615. The diphone residuals and the LPC coefficients are then stored in a compressed packet generated by the encoder in processing block 620. At processing block 625, upon a request from a waveform synthesizer for a particular diphone, the appropriate diphone residual is located in a compressed packet in processing block 630. The located diphone residual is then extracted from the compressed packet in processing block 635. The extracted diphone residual is decompressed, in processing block 640, using the modified G.723 decoder. Finally, at processing block 645, the diphone residuals, LPC coefficients, and pitch marks are supplied to the waveform synthesizer. The pitch marks are not compressed, and are therefore, supplied directly to the waveform synthesizer. The waveform synthesizer using the concatenative diphone database produces the intended speech output.

Figure 7:
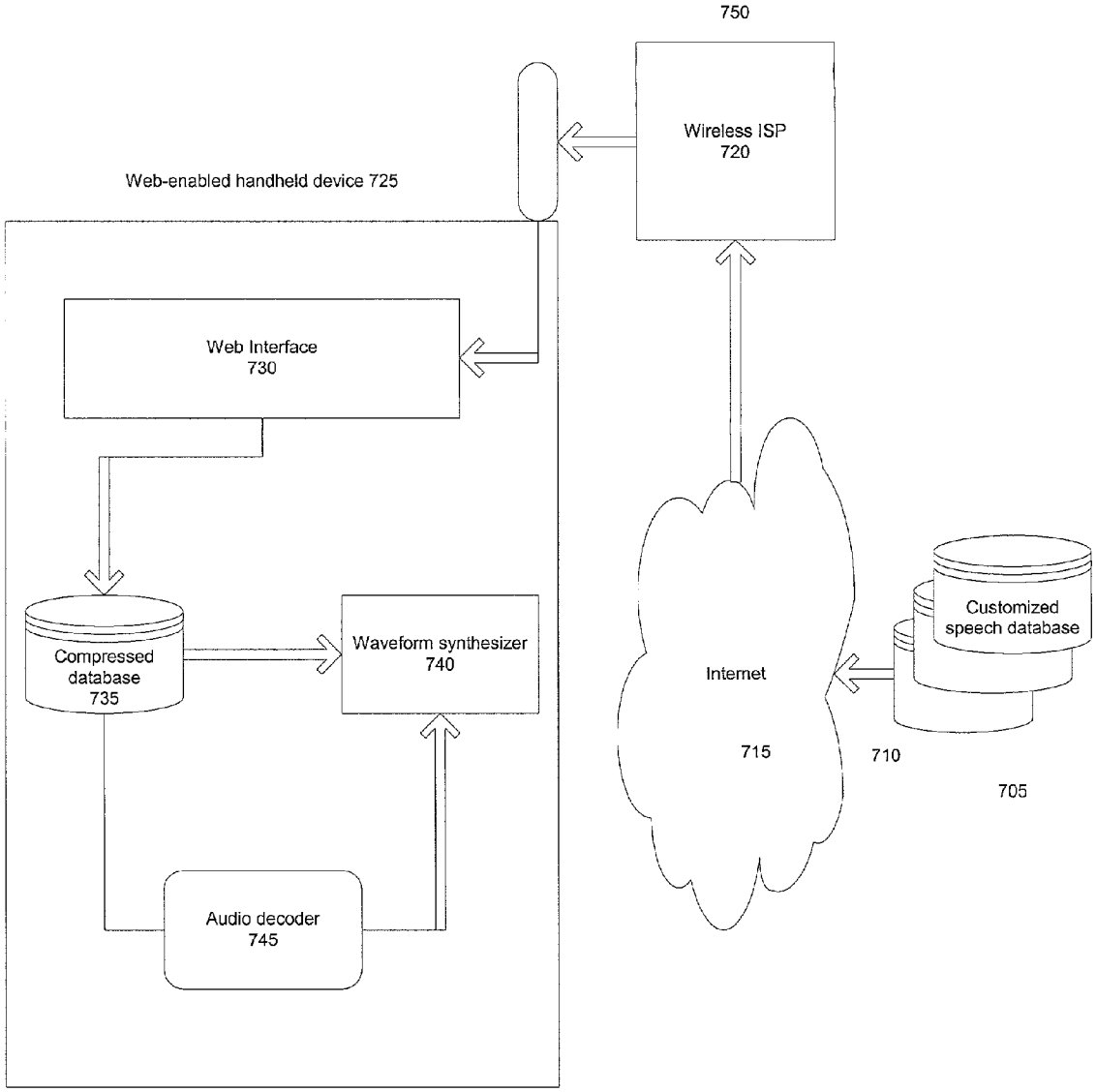
FIG. 7 is a block diagram illustrating a handheld device with a text-to-speech system using a compressed concatenative diphone database, according to one embodiment of the present invention.

FIG. 7 is a block diagram illustrating a handheld device with a text-to-speech system using a compressed concatenative diphone database, according to one embodiment of the present invention. As illustrated, the web-enabled handheld device 725 uses a wireless ISP 720 to have access to the Internet, and is web-interfaced 730. Currently, a handheld device, such as the one illustrated 725, could not have a TTS system, because its limited memory and low MIPS would not accommodate speech database of a necessary large size. The compression scheme of the present invention, where a speech database is compressed at a ratio of approximately 20:1, makes is possible for a handheld device to download the customized speech database. Further, the text authoring and analysis stage of the TTS system are separated from the synthesis stage, making it even easier to download the customized speech database. As illustrated, the waveform synthesizer 740 resides inside the handheld device 725.

Using an audio encoder 745, the speech database is compressed facilitating an easy download of the customized speech databases 705 to be used by the waveform synthesizer 740 along with any desired audio effects. The compression is performed anytime before the database reaches the handheld device 725; it can be done at the wireless ISP 720 or before accessing the Internet 715. The database can also be stored in a compressed form at the customized speech databases 705. In any case, the compressed database 735 in the handheld device 725 is decompressed using an audio decoder 745. The waveform synthesizer 740 accesses the database, and produces the intended output. The small memory footprint of the database enables the TTS system to be deployed in the handheld device 725 despite it 725 having limited memory and low MIPS. Further, the client-side data synthesis helps improve the quality of synthesized speech in the web-enabled handheld device 725, and eliminates the network artifacts on streaming audio when rendered from a website.

What is claimed is:

1. A method, comprising:

receiving input text at a client device;

analyzing the input text to determine diphones;

sending a request to a server for diphone waveform data based on the determined diphones;

locating the requested diphone waveform data by searching a concatenative diphone waveform database at the server;

generating a set of compressed diphone residuals and Linear Predictive Coding (LPC) coefficients by compressing results of the searched diphone waveform database;

storing the set of compressed diphone residuals and the LPC coefficients in a compressed packet;

transmitting the compressed packet to the client device; and upon receiving the compressed packet, the client device decompresses the compressed packet back to diphone waveform data available for use in a text-to-speech synthesizer.

2. The method of claim 1, wherein the generating of the set of compressed diphone residuals is performed using an encoder.

3. The method of claim 1, further comprising receiving the request from the text-to-speech synthesizer, the text-to-speech synthesizer residing at the client device.

4. The method of claim 1, further comprising providing pitch marks to the text-to-speech synthesizer.

5. The method of claim 2, wherein the encoder comprises a G.723 encoder.

6. A system comprising:

a sever;

a client device coupled the sever, the client device to receive input text, analyze the input text to determine diphones, and send a request to the server for diphone waveform data based on the determined diphones;

the server to locate diphone waveform data by searching a concatenative diphone waveform database, generate a set of compressed diphone residuals and Linear Predictive Coding (LPC) coefficients by compressed diphone residuals and the LPC coeffients in a compressed packet, and transmit the compressed packet to the client device; and the client device to decompress the compressed packet back to diphone waveform data available for use in a text-to-speech synthesizer.

7. The system of claim 6, wherein the server is further to generate the set of compressed diphone residuals using an encoder, the encoder including a G.723 encoder.

8. The system of claim 6, wherein the server is further to provide pitch marks to the text-to-speech synthesizer at the client device.

9. The system of claim 8, wherein the text-to-speech synthesizer at the client is further to receive the pitch marks.

10. The system of claim 6, wherein the client device comprises a handheld device including one or more of the following: a telephone, a pocket computer system, and a personal digital assistant (PDA).

11. A machine-readable medium having stored thereon data comprising sets of instructions which, when executed by a machine, cause the machine to:

receive input text at a client device;

analyze the input text to determine diphones;

send a request to a server for diphone waveform data based on the determined diphones;

locate the requested diphone waveform data by searching a concatenative diphone waveform database at the server;

generate a set of compressed diphone residuals and Linear Predictive Coding (LPC) coefficients by compressing results of the searched diphone waveform database;

store the set of compressed diphone residuals and LPC coefficients in a compressed packet;

transmit the compressed packet to the client device; and upon receiving the compressed packet, the client device decompresses the compressed packet back to diphone waveform data available for use in a text-to-speech synthesizer.

12. The machine-readable medium of claim 11, wherein the generating of the set of compressed diphone residuals is performed using an encoder.

13. The method of claim 11, wherein the sets of instructions which, when executed by the machine, further cause the machine to receive the request from the text-to-speech synthesizer, the text-to-speech synthesizer residing at the client device.

14. The machine-readable medium of claim 11, wherein the sets of instructions which, when executed by the machine, further cause the machine to provide pitch marks to the text-to-speech synthesizer.

* * * * *